US010098203B1

(12) United States Patent
Tucker et al.

(10) Patent No.: US 10,098,203 B1
(45) Date of Patent: Oct. 9, 2018

(54) ELECTRICAL LOAD CONTROLLER SYSTEM FOR USE WITH MULTIPLE REMOTE SWITCHING LOCATIONS

(71) Applicants: Terrance Wayne Tucker, Sausalito, CA (US); Patrick McIlwain, Sausalito, CA (US)

(72) Inventors: Terrance Wayne Tucker, Sausalito, CA (US); Patrick McIlwain, Sausalito, CA (US)

( * ) Notice: Subject to any disclaimer, the term of this patent is extended or adjusted under 35 U.S.C. 154(b) by 0 days.

(21) Appl. No.: 15/468,448

(22) Filed: Mar. 24, 2017

Related U.S. Application Data

(63) Continuation of application No. 14/017,354, filed on Sep. 4, 2013.

(51) Int. Cl.
*H05B 37/02* (2006.01)

(52) U.S. Cl.
CPC ..... *H05B 37/0209* (2013.01)

(58) Field of Classification Search
CPC ..... H01H 9/00; H01H 63/00; H01H 45/00; H02H 3/165; H05B 33/0887
USPC ..... 340/3.51, 3.21, 567, 522, 541, 600; 315/149
See application file for complete search history.

(56) References Cited

U.S. PATENT DOCUMENTS 3,119,046 A 1/1964 Usher
3,440,429 A * 4/1969 McDonald ..... H01H 21/025 200/314
4,667,073 A 5/1987 Osika
5,017,837 A * 5/1991 Hanna ..... G08B 5/36 315/119
5,170,068 A 12/1992 Kwiatkowski et al.
5,247,282 A * 9/1993 Marshall ..... A47G 29/1214 232/35
5,455,564 A * 10/1995 Hsiao ..... G08B 13/19 340/522
6,031,295 A * 2/2000 Wikander ..... B60Q 1/2611 307/10.1
6,040,969 A * 3/2000 Winch ..... H02H 11/002 307/127
6,172,432 B1 * 1/2001 Schnackenberg ..... H02J 3/14 307/125
6,297,724 B1 * 10/2001 Bryans ..... H05B 37/0254 307/38
7,061,248 B1 * 6/2006 Holland ..... G01R 35/04 324/508

(Continued)

*Primary Examiner* — Thai Pham
*Assistant Examiner* — Syed M Kaiser
(74) *Attorney, Agent, or Firm* — Malin Haley DiMaggio & Bowen, P.A.

(57) ABSTRACT

A system for controlling an electrical load such as a light mounted in a remote location that includes multiple SPDT momentary switches for turning the remote light on and off from different remote locations and a load controller connected to each of the three-way switches and to the light through a light fixture. Each of the switches has an upper momentary switch that turns the light on and a pilot light to indicate whether the remote light is on or off and a lower momentary switch that turns the remote light off and the pilot light off. The load controller and the three-way switches are easily installed into an existing residential or commercial electrical wiring and lighting system or for new residential and commercial installations. The system can also be installed in a two wire system or three wire system.

2 Claims, 2 Drawing Sheets

(56) References Cited

U.S. PATENT DOCUMENTS

| | | | | |
|---|---|---|---|---|
| 8,022,577 | B2 | 9/2011 | Grice | |
| 8,269,376 | B1 | 9/2012 | Elberbaum | |
| 9,706,625 | B2 * | 7/2017 | Hasler | H05B 37/0227 |
| 2007/0216313 | A1 * | 9/2007 | Soccoli | H05B 37/0209 315/149 |
| 2008/0062013 | A1 * | 3/2008 | Face | H03K 17/951 341/20 |
| 2008/0180866 | A1 * | 7/2008 | Wong | H02H 1/0015 361/45 |
| 2008/0297061 | A1 * | 12/2008 | Archdekin | H05B 41/38 315/219 |
| 2009/0251839 | A1 * | 10/2009 | Cruz | H02H 5/12 361/115 |
| 2009/0316318 | A1 * | 12/2009 | Wong | H02H 9/02 361/80 |
| 2010/0176661 | A1 * | 7/2010 | Wilson | H05B 37/0263 307/114 |
| 2011/0110673 | A1 * | 5/2011 | Elberbaum | G02B 6/3817 398/202 |
| 2011/0141647 | A1 * | 6/2011 | Garcia | H01H 23/145 361/166 |
| 2012/0257316 | A1 * | 10/2012 | Kamor | H01H 83/04 361/50 |
| 2012/0280512 | A1 * | 11/2012 | Bliven | H02K 53/00 290/1 A |
| 2013/0278168 | A1 * | 10/2013 | Testani | G05F 3/04 315/250 |
| 2014/0139047 | A1 * | 5/2014 | Haines | H01H 9/56 307/140 |
| 2017/0027040 | A1 * | 1/2017 | Hasler | H05B 37/0227 |

* cited by examiner

ELECTRICAL LOAD CONTROLLER SYSTEM FOR USE WITH MULTIPLE REMOTE SWITCHING LOCATIONS

CROSS REFERENCE TO RELATED APPLICATIONS

This application is a Continuation of U.S. patent application Ser. No. 14/017,354 filed on Sep. 4, 2013.

STATEMENT REGARDING FEDERALLY SPONSORED RESEARCH OR DEVELOPMENT

N/A

BACKGROUND OF THE INVENTION

Field of the Invention

This invention relates to the control of an electrical load that includes the use of multiple remotely located switches so that the user can readily determine whether or not there is power to the load regardless of the user's location. Specifically the invention relates to a lighting control system that includes one or more lights that can be remotely turned on and off by a plurality of single pole double throw (SPDT) momentary switches from different locations. The user knows if the remote light is on or off. The system can be easily installed in a multitude of different residential or commercial environments regardless of the existing wiring situation.

Description of the Related Prior Art

The use of multiple switches to control a single light or device is well known, especially with the use of three-way and four-way switches. Typically a light can be turned on and off from two or more separate remote locations. Often the user positioned at a light switch cannot see whether or not the light is on or off. Because of the multiple combinations using three or four way switches for on-off, it is not intuitive using a specific three or four way switch to determine whether the light is in fact on or is in fact off based on the position of the switch.

One of the problems with retrofitting a new lighting control system is the large variety of electrical wiring installations currently found, making challenging retrofitting lighting systems. Obviously most electrical wires are contained within wall structures thereby eliminating easy access to changing or re-routing wiring that currently exists. New installations are much easier to deal with since most of the electrical wiring will be installed before the walls and panels have been put in place so that many different wiring choices can be made based on the practicality of the situation.

The present invention provides a light or device controller system that can employ multiple SPDT momentary switches and a load controller that is intuitively distinguishable by the user as to "on and off" because of the switch activation in which up is always "on" and down is always "off" combined with a pilot light if light or device is not in clear view. Also the controller and three-way switching set up can easily be installed in either a two wire existing system or a three wire existing system.

SUMMARY OF THE INVENTION

A control system for controlling one or more lights that utilizes two or more SPDT momentary switches at different remote locations from the light that permit the user to readily turn a remote light or device on and off using momentary switches in which up is on and down is off in conjunction with a pilot light if desired on the three way switch housing that illuminates whenever the light or device is on. The control system is readily installable in existing electrical circuits in residential and commercial buildings and is readily installed in new residential and commercial buildings.

The control system includes a relay load control circuit and two or more SPDT momentary switches efficiently wired to accommodate an existing electrical wiring system within a residential or commercial building. When a user activates a momentary wall switch to activate the light, pressing the up direction on the switch closes which is electrically connected to a relay that is closed connected to a power source and to the light thereby activating the light when the relay closes the switch. At the same time an optional pilot light mounted in the wall switch box indicates that the light is powered on.

When the user depresses the momentary light switch in a downward direction the switch closes which is connected to a signal wire through the relay controller. The normally closed relay switch is thus opened, breaking the connection with neutral to the load relay, which powers the light, thereby turning the light off. The pilot light is also then disconnected from the power source turning off the pilot light. The user then knows that the remote light or device (which is the load) is off.

The controller system described herein can be easily and quickly mounted and installed in an existing electrical system either residential or commercial whether it is a two wire system or three wire system. The controller relays may include a three-way switch and a pilot light in the housing that includes the relay circuitry and relay switches. Or the applicable controller can be installed within the light or device enclosure as the existing configuration demands. The relay controllers can be wired differently to accommodate a two wire system as a retrofit or three wire system. The effect is the same however in the operation of the controller system herein. A user depresses a momentary wall switch upwardly, closing the switch that provides line power to the relay, closing the relay switch which in effect provides power to the load which is a light, causing the light to illuminate since the circuit is completed between the line and the load. To turn the light off, in effect when a user depresses the momentary switch in a downward direction, a second relay switch which is normally closed and connected to neutral and the load is opened, thereby breaking the circuit between the line and the load which is the light or device. This also turns off the pilot light.

The system for controlling a load such as the light uses two or more SPDT momentary switches. The relay controller is constructed for easy operation for the user for turning on and off the remote light and knowing the condition of the light whether the light is on or off virtually from any remote switch to allow intuitive operation of the switch by a user. Up always means on and down always means off.

It is an object of this invention to provide a load controller system for an electrical light or other electrical load that can be intuitively turned on and off using two or more SPDT momentary switches that are remotely disposed from the light so that the user quickly and easily knows whether the light is on or off.

It is another object of the invention to provide a system for controlling an electrical load such as a light using a plurality of SPDT momentary switches and a relay system that can be easily and quickly installed into existing electrical wiring in a residential or commercial building in multiple wiring configurations. These and other objects will be readily apparent to one of skill in the art.

PREFERRED EMBODIMENT OF THE INVENTION

The lighting control system described herein that forms the basis of the invention can be installed in a new residential or commercial building or retrofitted into an existing residential or commercial building. Installation in a new building before the wall structures are installed allows for more potential different wiring setups because of such easy access to the internal junction box wiring between switches and the light fixture. In existing buildings, the different types of wiring available between the three-way switches, relays and light fixtures is more restricted because one must deal with the existing wiring which can be in many variations. Regardless of whether it is an existing building or new construction, the goal of installing the present invention remains the same which is to provide a lighting control system that allows a user the intuitive ability to select on and off even for a remote light that is not visible to the user at the time the power is selected and to provide a pilot light if needed.

Figure 1:
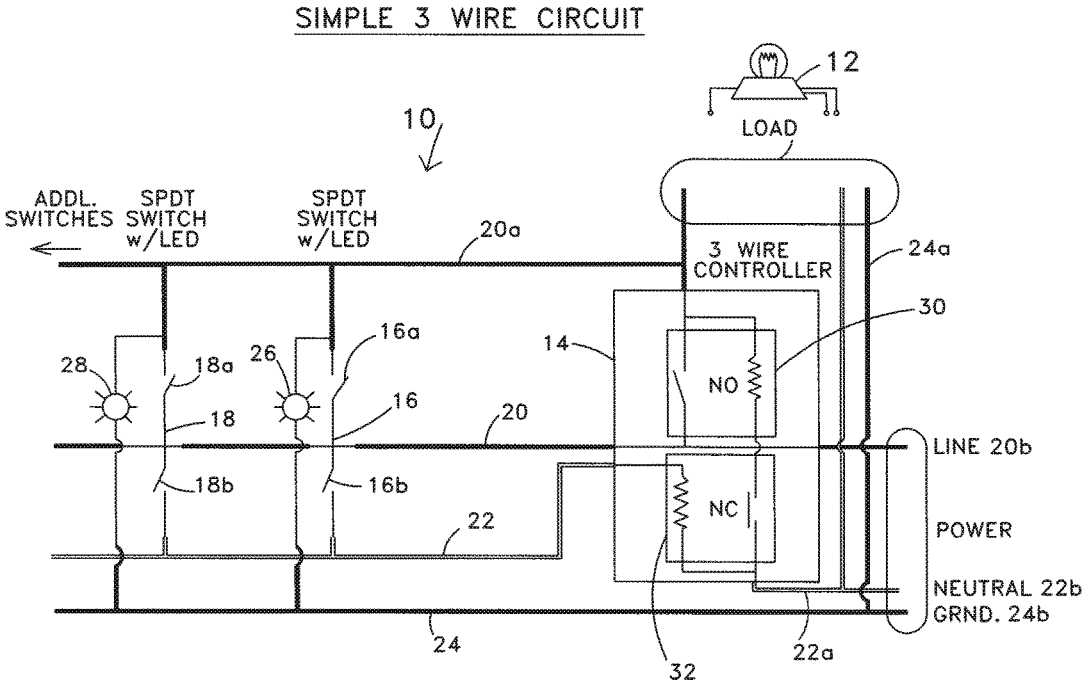
FIG. 1 shows a schematic diagram of one circuit representing the invention.

FIG. 1 shows the first embodiment which includes the use of a load control system, and SPDT momentary switches in a three wire circuit that includes line voltage 20*b*, neutral 22*b*, and ground 24*b*. This system can be used in an existing three wire electrical system or in new construction.

The load 12 is an electric light and light fixture or device that is connected to the system through line 20*a*, neutral 22*a* and is grounded using ground 24*a*. The line voltage input 20*b* represents the voltage from the power box in the building. Likewise neutral input 22*b* is part of the building wiring system from the box. The ground input 24*b* is part of the entire grounding system for the building that can go to the fixture representing lighting fixture 12.

A three wire controller 14 is connected directly to the lighting fixture 12 and controls the electrical power on and off to the lighting fixture 12. Controller 14 includes a first relay 30 which is normally open and which is connected to the line voltage 20 and neutral 22*a*. Controller 14 also includes a second relay 32 that is normally closed and that is connected to neutral 22*a* and 22.

Controller 14 can include a SPDT momentary switch and be mounted in a switch junction box and cooperates with the other switches which are remotely disposed throughout the building relative to the light fixture 12.

A single pole double throw momentary electrical switch 16 is shown that includes a pilot light LED 26. SPDT momentary switch 16 which is conventional has an "on" switch 16*a* that works in conjunction with the "off" switch 16*b*. Switch 16 is connected to the line voltage 20 at its common input. The line voltage 20 is also connected to relay 30. Additional connections for three-way switch 16 include signal 22 through switch 16*b*. Pilot light 26 which can be an LED is connected between the line voltage 20*a* and ground 24.

A second remotely disposed SPDT momentary switch 18 is electrically connected through and to three-way switch 16 such that the line voltage 20 is connected to the common input contact in three-way switch 18. Switch 18*a* is connected to the line voltage 20*a*. Switch 18*b* is connected to signal 22. Pilot light 28 is connected to line voltage 20*a* and ground 24.

The controlling device 10 shown in FIG. 1 can thus be used to turn off light fixture 12 which represents the load by activating the upper switch 16*a* manually or 18*a* manually each disposed in a different remote location from light fixture 12. This will turn the light on. The user would activate lower switch 16*b* or 18*b* to turn off the light in light fixture 12. When upper switch 16*a* or 18*a* are activated the pilot lights 26 and 28 respectively will also be illuminated when the light fixture or device 12 is on.

The manual SPDT momentary switch can be "Decora" or toggle switch 16 that can be intuitively activated by user so that the upper portion of the switch always turns the light on and the lower part of the switch always turns the light off regardless of the configuration of the other existing switches in the system. The user will also have the indicator light or pilot light 26 or 28 to tell whether or not the remote light in the light fixture 12 is on or off if needed. The present invention eliminates previous user confusion with a plurality of three-way light switches which did not have a consistent on or off position to determine whether or not the light that is remotely located was on or off.

The operation of the three way controller shown in FIG. 1 in conjunction with a pair of SPDT momentary switches operates as follows. If the user selects the upper SPDT momentary switch 16*a*, line voltage be connected to wire 20*a* which will also go through normally open solenoid 30 causing the solenoid to latch closing the circuit between input line voltage 20*b* to load or lighting fixture 12. Neutral 22*b* input is directly connected to light fixture 12 therefore the light will be illuminated. Also power to line 20*a* provides voltage to the LED pilot light 26 and 28 which are grounded at ground 24. In this configuration, pressing the up momentary switch 16*a* powers relay 30 and controller 14 causing the light fixture 12 to have power. To turn the light off, the user can depress SPDT momentary switch 16*b* which is the lower switch or 18*b* in three-way switch 18 also remotely disposed. This causes current through relay 32 that is normally closed causing the relay to open thereby shutting the neutral to relay 30 which returns to its normally open state turning off all power to the load.

The three wire controller circuit and SPDT momentary switches shown in FIG. 1 can thus be used in a new or existing residential or commercial building that employs a three wire system. Once installed pressing the upper switch intuitively turns the light on while pressing the lower switch turns the light off.

Figure 2:
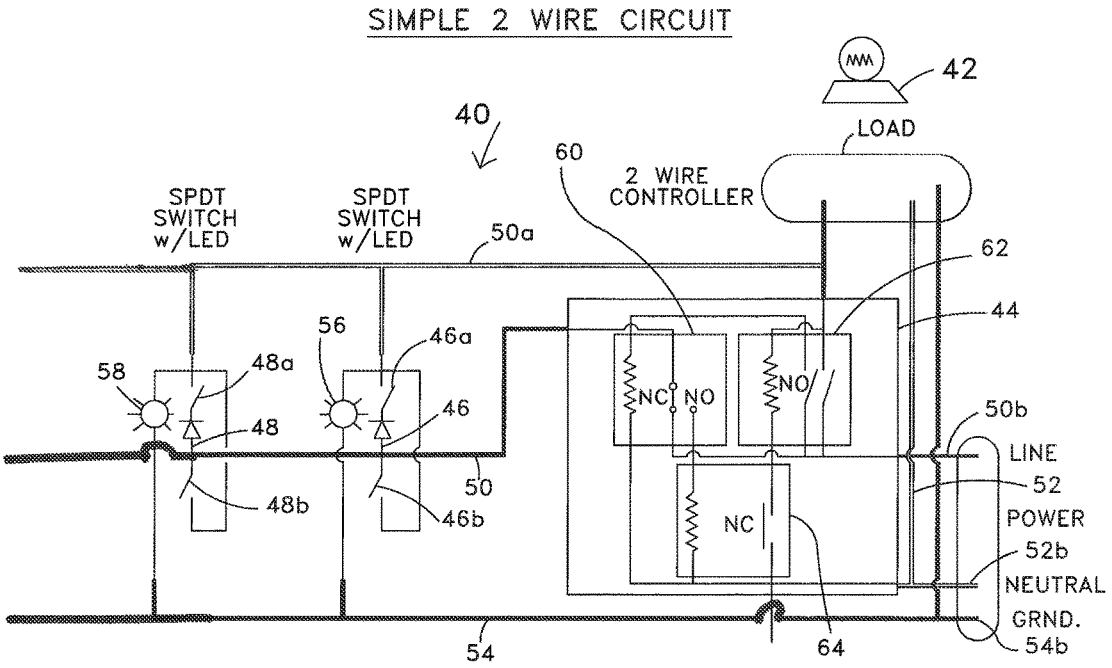
FIG. 2 shows a schematic diagram of an alternate embodiment of the invention representing a two wire system.

Referring now to FIG. 2, a two wire controller system 40 for use with a plurality of single pole double throw switches is shown. The light fixture 42 is connected to two wire controller 44 which controls the line power input 50*b* through controller 44. A pair of SPDT momentary switches (with jumper and blocking diodes) 46 and 48 are connected together electrically and are also connected to the controller 44. A user depressing the upper switch 46*a* on switch 46 allows the line voltage and current to be established from the line input 50*b* through normally closed contact of relay 60 to cause current to flow through relay 60 switching line 50 from source line 50*b* to coil of relay 64 becoming the off signal line. When bottom of switch 46 or 48 is depressed power is passed through jumper from line 50*a* through line

50 and relay 60 to open normally closed relay 64 to interrupt the neutral to relay 62 turning off the light or device. Also line voltage and 50*a* causes pilot light 56 and pilot light 58 to become illuminated through the ground 54 when the electric fixture 42 is illuminated. Again the SPDT momentary switches as disclosed are 46 and 48. A blocking diode has been added within the up (on) circuit of switch 46 and 48 to block current path between line 50*a* and line 50*b* in the event the switch is actuated up (on) while the light or device is already on. The current path is opposite (line voltage coming through relay 60 and line 50 to line 50*a*, actuating relay 62) with the system in the off status. When the user decides to turn light fixture 42 off, the user depresses the lower SPDT momentary switch such as 46*b* or 48*b*. This user action will open relay 64 causing closed relay 62 to open disconnecting the line current from fixture 42 turning the light off. This will also cause pilot light 56 and 58 to be turned off. Note that activation of either lower switch 46*b* and 48*b* will in effect turn off the load power to light fixture 42 from the input line 50*b*. Thus the system can be used with a two wire controller 44 shown in FIG. 2 or a three wire controller 14 shown in FIG. 1. With the use of either of the relay controllers described herein the remotely located multiple SPDT momentary switches can be used intuitively by a user to control a remotely located light that is not observable at the switch by the user such that the user pushes up on the switch momentarily which causes the light to always go on or pushes down on the lower switch momentarily which causes the like to go off regardless of which switch is being used by the user. In addition each switch has a pilot light as an extra indicator of the status of the remote light.

The instant invention has been shown and described herein in what is considered to be the most practical and preferred embodiments. It is recognized, however, that departures may be made therefrom within the scope of the invention and that obvious modifications will occur to a person skilled in the art.

We claim:

1. A system for controlling electrical power to a load such as a light mounted in a light fixture from multiple remote locations often not viewable by a user comprising:

a first switch having a momentary on position and off position;

at least one or more additional switches having momentary on position and an off position;

line voltage wire from a voltage source;

neutral wire from said voltage source;

electrical load controller including a plurality of relay switches connected to said line voltage wire;

said neutral wire connectable to said light;

said electrical load controller having a normally open first relay switch connected between the line voltage wire and said neutral wire;

said line voltage wire connectable to said light, said normally open first relay switch being closed to provide line voltage to said light; and said one or more additional multiple switches each independently connected to said first relay, and the said additional switch providing power to said first relay and said on switch on a second switch providing power to said first relay in said electric control loader in the up on position thereby capable of turning the light on, pilot lights connected to multiple switches such that said all pilot lights illuminate when any said multiple switches are positioned in the momentary on position and also when any switch is positioned in an up position indicating that said light which may be remotely situated is illuminated.

2. The system as in claim 1, including:

said electrical load controller including a second relay including a normally closed second relay switch connected to said neutral wire and to said at least one or more additional switches lower position off switch, said second relay being activated when any lower switch is closed, said normally closed second relay switch opening through said neutral wire causing said normally open first relay switch to return to its normally open position turning off line power to said light fixture.

* * * * *